US011542116B2

(12) United States Patent
Cockerell

(10) Patent No.: US 11,542,116 B2
(45) **Date of Patent: *Jan. 3, 2023**

(54) HOSE HOLDER

(71) Applicant: Jesse Jameson Cockerell, Fort Worth, TX (US)

(72) Inventor: Jesse Jameson Cockerell, Fort Worth, TX (US)

( * ) Notice: Subject to any disclaimer, the term of this patent is extended or adjusted under 35 U.S.C. 154(b) by 76 days.

This patent is subject to a terminal disclaimer.

(21) Appl. No.: 17/102,600

(22) Filed: Nov. 24, 2020

(65) Prior Publication Data

US 2021/0179384 A1 Jun. 17, 2021

Related U.S. Application Data

(60) Provisional application No. 62/974,676, filed on Dec. 16, 2019.

(51) Int. Cl.

| | |
|---|---|
| ***B65H 75/26*** | (2006.01) |
| ***B65H 75/44*** | (2006.01) |
| ***B65H 75/08*** | (2006.01) |
| ***B65H 75/36*** | (2006.01) |

(52) U.S. Cl.

CPC ..... *B65H 75/366* (2013.01); *B65H 75/08* (2013.01); *B65H 75/265* (2013.01); *B65H 75/446* (2013.01); *B65H 75/4478* (2013.01); *Y10T 137/6918* (2015.04)

(58) Field of Classification Search

CPC ..... B65H 75/265; B65H 75/446; B65H 75/4478; B65H 75/08; B65H 75/366; Y10T 137/6918

USPC ..... 137/355.12, 355.16–355.28; 242/613.2

See application file for complete search history.

(56) References Cited

U.S. PATENT DOCUMENTS

| | | | | | |
|---|---|---|---|---|---|
| 289,960 | A * | 12/1883 | Billings | B65H 75/4492 | 137/355.27 |
| 1,132,065 | A * | 3/1915 | Bernhard | B65H 75/366 | 248/89 |
| 3,029,933 | A * | 4/1962 | Sutter | B65D 85/54 | 206/231 |
| 5,419,362 | A * | 5/1995 | Blackaby | B65H 75/366 | 248/89 |
| 5,988,570 | A * | 11/1999 | Gretz | H02G 3/32 | 248/89 |
| 6,328,060 | B1 * | 12/2001 | Smith | B67D 7/40 | 137/355.23 |
| 6,883,537 | B1 * | 4/2005 | Lin | B65H 75/36 | 137/355.16 |
| 11,199,279 | B2 * | 12/2021 | Uffner | F16L 3/23 | |
| 11,447,363 | B2 * | 9/2022 | Cockerell | B65H 75/366 | |

(Continued)

*Primary Examiner* — Kevin F Murphy
*Assistant Examiner* — Jonathan J Waddy
(74) *Attorney, Agent, or Firm* — D. Tiller Law PLLC; Donald Tiller

(57) ABSTRACT

The present invention is directed to a hose holder that nests individual hose loops separately in grooves formed on (or forming) a sloped surface. The holder includes a series of arched grooves, each groove provided at a different position along the slope of the surface such that adjacent grooves are at different vertical heights when the holder is mounted for use. Grooves further from the mounting point are lower than those nearer. In general, each groove is wide enough to hold and guide a single loop of hose and is configured for easy deployment of the hose when the hose is pulled away from the hose holder.

17 Claims, 4 Drawing Sheets

(56) References Cited

U.S. PATENT DOCUMENTS

| | | | | |
|---|---|---|---|---|
| 2002/0074462 | A1* | 6/2002 | Pontecorvo | B65H 75/366<br>248/89 |
| 2010/0270440 | A1* | 10/2010 | Goetz | B65H 75/4478<br>368/10 |
| 2021/0284482 | A1* | 9/2021 | Cockerell | B65H 75/265 |

* cited by examiner

HOSE HOLDER

CROSS-REFERENCE TO RELATED APPLICATIONS

This application claims the benefit of U.S. Provisional Application No. 62/974,676 filed on Dec. 16, 2019.

BACKGROUND

The invention is generally directed to a hose holder that arranges the hose in loops positioned in separate grooves positioned at different heights.

Currently, there are a number of solutions for storing and removing hoses. Some of these solutions attempt to serve as hose organizers, but these solutions fail to meet the needs of the industry because the loops are not organized in a first-length-to-use pattern or a last-length-to-use pattern. Other solutions attempt to compress the loops into a tightly wound hose pots, but these solutions are similarly unable to meet the needs of the industry because it is an unusually laborious process to insert the hose into a pot or bucket and to compress it into numerous tight loops. This may lead to kinking the hose and an unordered looping of the hose; thus, preventing extraction of the hose in a correct untangled order. Other solutions seek to provide hose storage but fail in placing the loops in an order that is positioned for the next use of the hose. Some solutions also fail to meet industry needs because they fail to establish a pattern for vertical storage that can be visually understood and taught to others. Instead, all the hose loops are stacked on top of each other and the loops get tangled, which leads to uncertainty regarding the order of the loops on the holder.

SUMMARY

It is desirable to have technology for convenient storage and deployment of a hose. This hose holder includes hose-guiding grooves that are configured based on the future use of the hose to decrease the tangling and snarling of hose. It is also desirable to have a hose holder that is straightforward to use and easy to learn how to use. This may be accomplished through the use of grooves that are visible to the user. It is also desirable to have a simple rack system to decrease production and materials cost. The disclosed device advantageously fills these needs and addresses the aforementioned deficiencies by providing a groove pattern for storing and removing hoses.

A hose holder according to an aspect of the invention includes a series of hose-holding grooves that are arranged on (or form) a sloped surface. The grooves are disposed on the surface (or form the surface) such that horizontally adjacent grooves will be at different vertical positions in use. (As used herein, the "vertical axis" of the hose holder refers to the axis of the holder that would be substantially vertical when the holder is mounted for use and the "horizontal axis" is perpendicular to the "vertical axis." Thus, horizontally adjacent grooves are those at adjacent positions along the holder's horizontal axis and the vertical positions of the groove refers to the position of the groove bottom along the holder's vertical axis.) The grooves may each be configured to hold a single hose loop (in other words, the grooves have a width roughly the same or slightly larger than the hose diameter). In use, the hose section near the first end of the hose is positioned in the groove at the lowest vertical position and the hose section near the other end of the hose is positioned in the groove at the highest vertical position.

Loops of the hose are placed in the grooves such that sections of hose nearer to the first end are placed in grooves having a lower vertical position than are sections of the hose nearer to the other end. This helps separate the loops and provides guidance as to where each loop should be placed. It also prepares the hose for future use as the hose is removed from the holder grooves progressing from the lower-vertical-position grooves to the higher-vertical-position grooves.

According to an aspect of the invention, the hose-holder grooves may be defined by a roughly U-shaped surface with unequal edge heights, such that the edge toward the lower end of the holder's sloped surface does not extend as high as the edge toward the higher end of the sloped surface. This allows a hose loop to be individually removed by pulling the hose away from the holder. The hose that is not pulled off stays on the holder.

According to another aspect of the invention, the grooves may be configured roughly as a series of concentric elliptical arcs, each arc having a different vertical and horizontal position than the other arc surfaces. Each arc may have a different width. The widths of the arcs may decrease as the horizontal position of the arc with respect to the holder's mounting surface increases.

A hose holder according to an aspect of the invention may also have variously placed holes and outlets that enable the holder to have multiple mounting options. For example, the holder may include various holes to enable mounting via bolts or screws or string or hooks or zip ties or the like. And the holder may include various holes to enable mounting on different surfaces or in different configurations. The holder may include a pivotable mounting bracket that could, for example, allow the holder to reorient to follow the hose user as the user pulls the hose off the holder.

A hose holder according to an aspect of the invention improves over prior-art holders in any of a variety of ways. For example: Separate grooves for separate hose loops enable a more orderly storage of the hose. Disposing the grooves along a sloped surface eases hose deployment. Having a groove edge of lower height on the deployment side of the groove than the other side of the groove further eases hose deployment. Having arced grooves of decreasing widths further eases hose deployment. And the structure of the grooved and sloped surface may provide a mechanical stiffening of the holder without the need for additional support or strengthening components or features.

BRIEF DESCRIPTION OF THE DRAWINGS

These and other features, aspects, and advantages of the present invention will become better understood with reference to the following description, appended claims, and accompanying drawings where:

DETAILED DESCRIPTION

Figure 1:
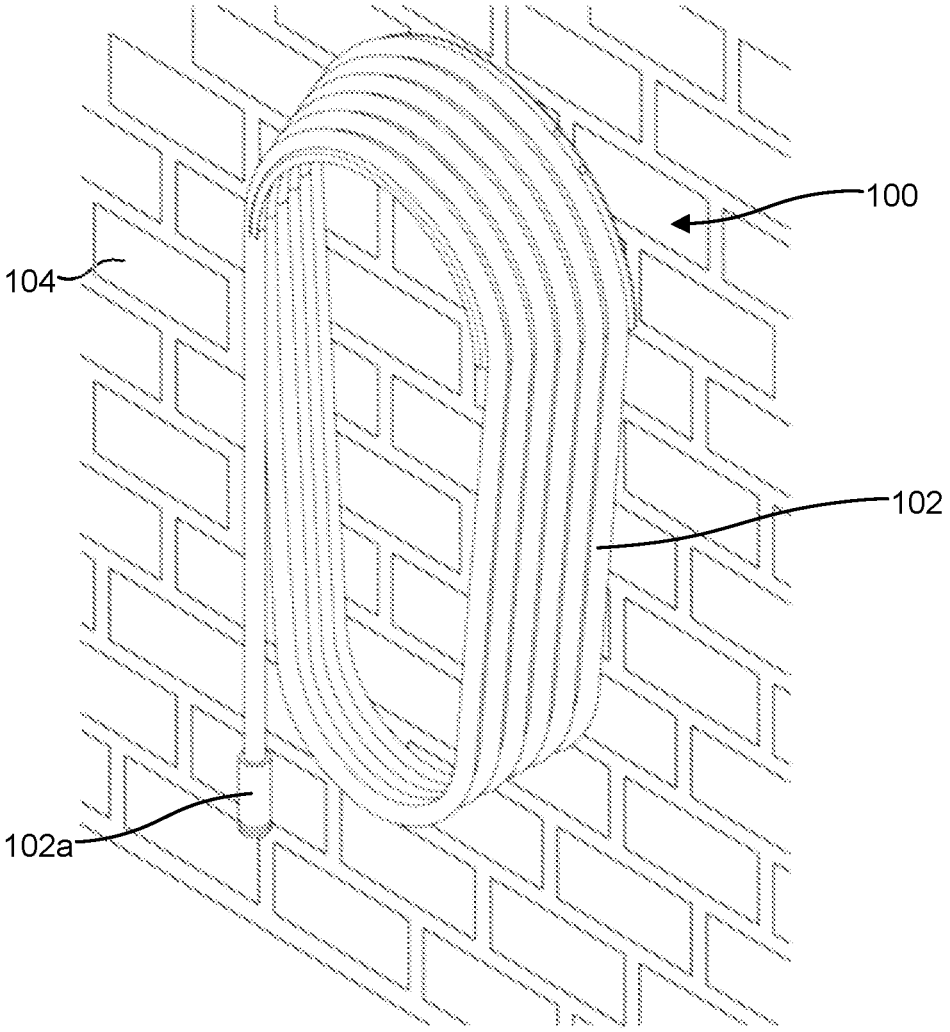
FIG. 1 depicts an exemplary hose holder holding a garden hose and attached to a wall.

In the summary above, and in the description below, reference is made to particular features of the invention in the context of exemplary embodiments of the invention. The features are described in the context of the exemplary embodiments to facilitate understanding. But the invention is not limited to the exemplary embodiments. And the features are not limited to the embodiments by which they are described. The invention provides a number of inventive features which can be combined in many ways, and the invention can be embodied in a wide variety of contexts. Unless expressly set forth as an essential feature of the invention, a feature of a particular embodiment should not be read into the claims unless expressly recited in a claim.

Except as explicitly defined otherwise, the words and phrases used herein, including terms used in the claims, carry the same meaning they carry to one of ordinary skill in the art as ordinarily used in the art.

Because one of ordinary skill in the art may best understand the structure of the invention by the function of various structural features of the invention, certain structural features may be explained or claimed with reference to the function of a feature. Unless used in the context of describing or claiming a particular inventive function (e.g., a process), reference to the function of a structural feature refers to the capability of the structural feature, not to an instance of use of the invention.

Except for claims that include language introducing a function with "means for" or "step for," the claims are not recited in so-called means-plus-function or step-plus-function format governed by 35 U.S.C. § 112(f). Claims that include the "means for [function]" language but also recite the structure for performing the function are not means-plus-function claims governed by § 112(f). Claims that include the "step for [function]" language but also recite an act for performing the function are not step-plus-function claims governed by § 112(f).

Except as otherwise stated herein or as is otherwise clear from context, the inventive methods comprising or consisting of more than one step may be carried out without concern for the order of the steps.

The terms "comprising," "comprises," "including," "includes," "having," "haves," and their grammatical equivalents are used herein to mean that other components or steps are optionally present. For example, an article comprising A, B, and C includes an article having only A, B, and C as well as articles having A, B, C, and other components. And a method comprising the steps A, B, and C includes methods having only the steps A, B, and C as well as methods having the steps A, B, C, and other steps.

Terms of degree, such as "substantially," "about," and "roughly" are used herein to denote features that satisfy their technological purpose equivalently to a feature that is "exact." For example, a component A is "substantially" perpendicular to a second component B if A and B are at an angle such as to equivalently satisfy the technological purpose of A being perpendicular to B.

Except as otherwise stated herein, or as is otherwise clear from context, the term "or" is used herein in its inclusive sense. For example, "A or B" means "A or B, or both A and B."

An exemplary hose holder 100 according to an aspect of the invention is depicted in FIG. 1. The hose holder 100 is shown mounted to a brick wall 104 and holding a hose 102. The hose 102 is positioned in the holder 100 such that the loop furthest from the wall 104 terminates in the first hose end 102*a* with a fitting suitable for attaching to a nozzle or sprinkler, for example. The other (second) hose end (not shown) has a fitting suitable for attaching to, for example, a water faucet. The hose 102 is looped in the grooves of the holder 100 such that hose sections nearer the first hose end 102*a* than the second hose end are in grooves further away from the wall 104 than are hose sections nearer the second hose end than the first hose end 102*a*. When positioning the hose 102 on the holder 100, the hose loop nearest to the first hose end 102*a* is the last loop placed on the holder 100. The loop nearest the wall 104 (the one nearest the second hose end) is the first loop placed on the holder 100. The hose 102 is looped on the holder 100 sequentially from second hose end to the first hose end 102*a*, with loops further along the hose from the second hose end positioned in grooves of the holder 100 that are further along the holder 100 from the wall 104. In use, this pattern allows the user to gently pull the hose end away from the wall and gravity gently drops the first loop to the ground. The other loops stay in place on the holder. There is no need to lift, carry, and guess how much hose length one will need for the task. As the user moves away from the holder 100, the next length of loop falls to the ground.

The holder 100 is attached to the wall 104 at a height (above the ground or other floor or the like) determined by the length of the hose 102. For example, the holder 100 would be placed at a height of about 5 feet for a hose of about 50-75 feet long. Longer hoses may be accommodated simply by raising the attachment height of the holder 100. For extremely long hoses, a second layer of loops can be placed on top of the first layer of loops. The ordering of the loop of the second layer of hose loops will be the same as the for the first layer.

The hose holder 100 may be constructed, for example, using sheet metal that is contoured into the appropriate shape (e.g., by stamping or deep drawing), where the hose-guiding grooves provide the mechanical stiffening necessary to support the hose 102. Other materials and formation processes may also be suitable. For example, the holder 100 may be plastic or metal and it may be molded, injected, or cast. The holder 100 is not limited in this regard.

Figure 2:
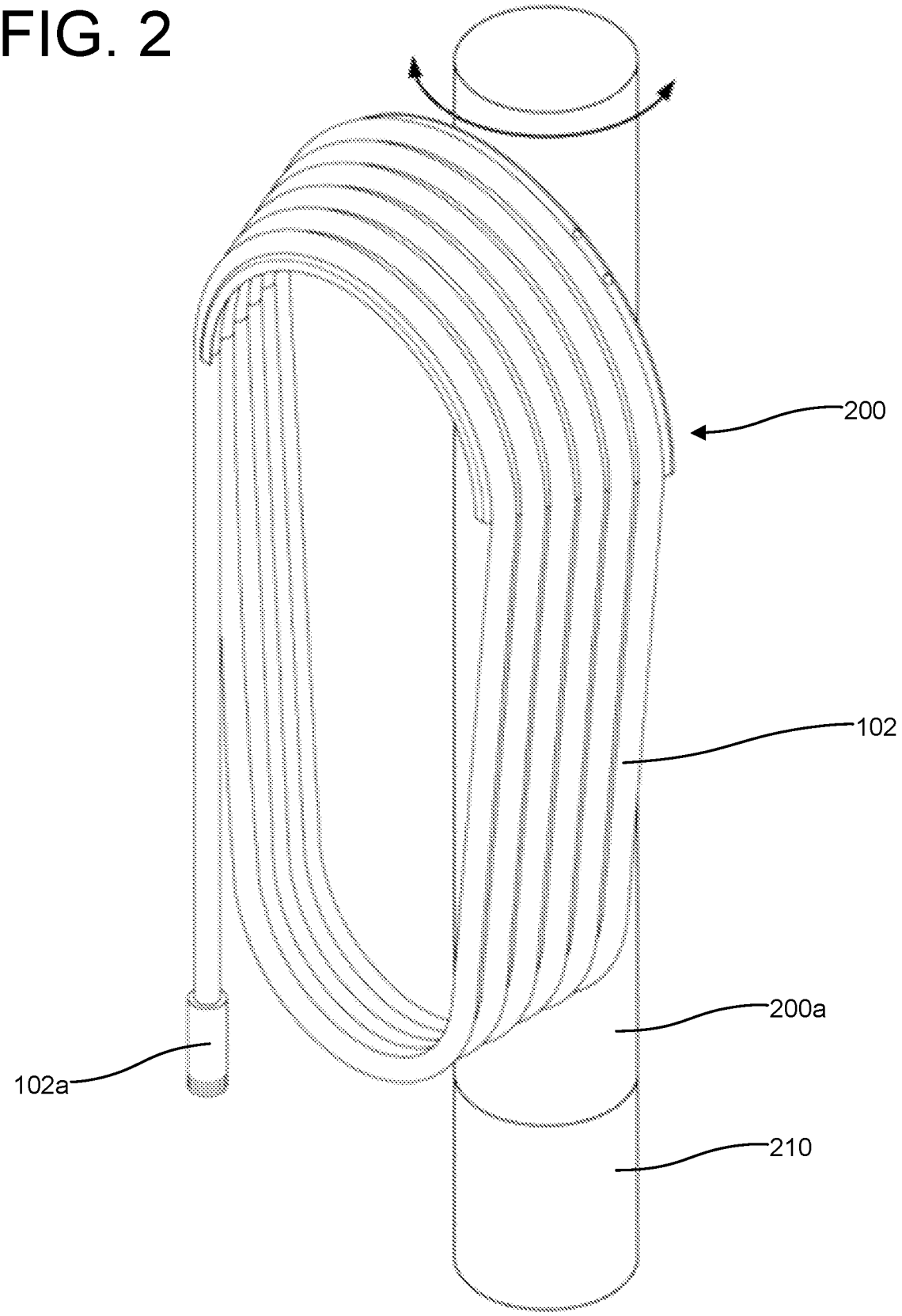
FIG. 2 depicts an exemplary hose holder holding a garden hose and pivotally attached to a pole.

Another exemplary hose holder 200 is depicted in FIG. 2. The hose holder 200 is pivotably mounted to a post 210. In one embodiment, the hose holder 200 includes a sleeve 200*a* configured to fit over and pivot around the post 210. Other suitable pivotable mounts include hinges, ball joints, and other articulating joints. The hose 102 is positioned on the holder 200 in the same fashion described above with reference to FIG. 1. The pivotable mount allows the holder 200 to pivot on the post to follow the hose 102 as it is pulled of the holder 200. This will aid the user of the hose 102 as the user positions the first hose end 102*a* for use.

Figure 3A:
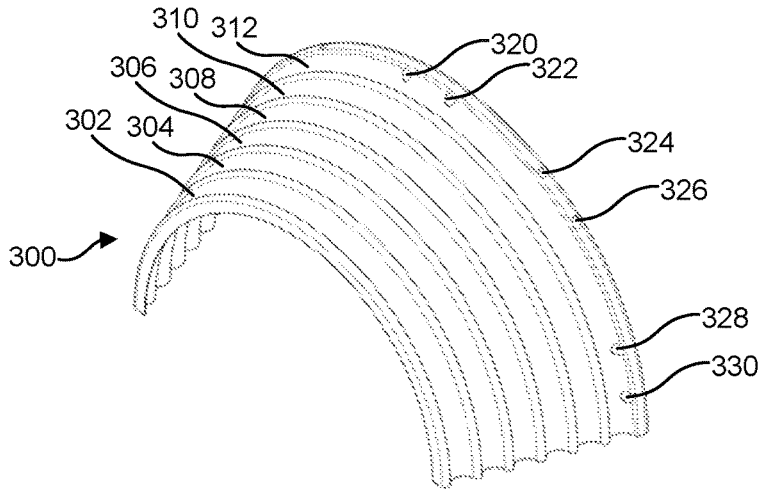
FIGS. 3A-3C depicts various views of an exemplary hose holder.
Figure 3B:
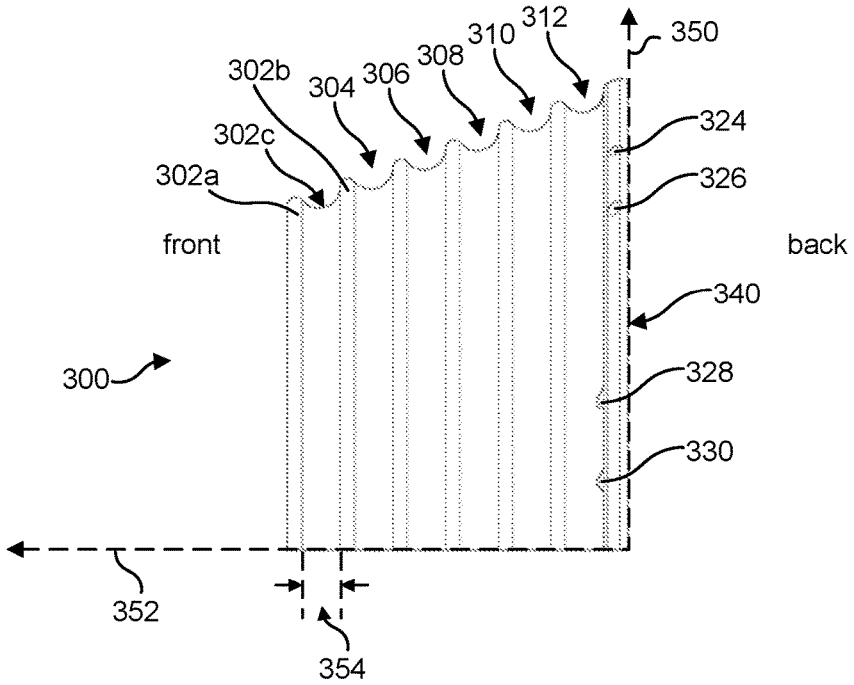
Figure 3C:
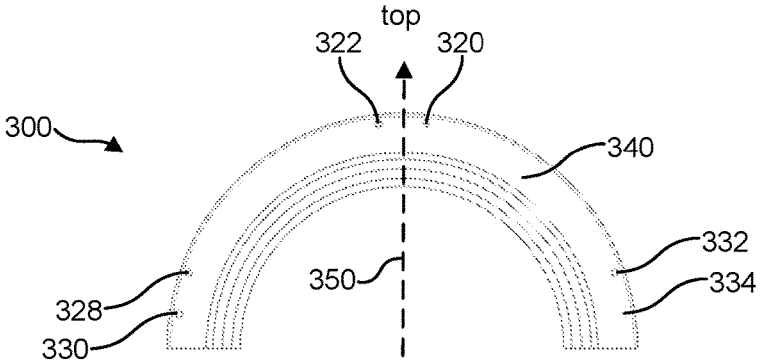

An exemplary hose holder 300 is depicted in various views in FIGS. 3A-3C. FIG. 3A is a perspective view, FIG. 3B is a side view, and FIG. 3C is a back view. The holder 300 includes a holder-mounting surface 340 and a plurality of grooves 302, 304, 306, 308, 310, 312 forming (or formed on) a hose-bearing surface sloped relative to the holder-mounting surface 340. When the holder-mounting surface 340 is oriented substantially vertically, the bottoms of the grooves 302, 304, 306, 308, 310, 312 are at different vertical positions, with the vertical position decreasing with the horizontal distance of the groove from the holder-mounting surface 340. (For reference, the holder's 300 vertical axis 350 and horizontal axis 352 are depicted in dashed lines in FIG. 3B.) This slope of the hose-holding surface (the difference in vertical positions of the grooves) provides a gravitational aid to deploying a hose, with hose loops sequentially falling off the holder when pulled.

Each groove 302, 304, 306, 308, 310, 312 is configured roughly in a U-shape to guide and hold a hose loop. The shape of the each groove 302, 304, 306, 308, 310, 312 is defined in part by the two edges of the groove. The edge of the groove that is farther away from the holder-mounting surface 340 is shorter than the edge that is nearer the holder-mounting surface 340. For example, as shown FIG. 3B, the groove 302 that is farthest away from the holder-mounting surface 340 is defined in part by two edges 302*a*, 302*b* (the groove bottom 302*c* is also denoted for reference). The edge 302*a* that is farther away from the holder-mounting surface 340 is shorter than the other edge 302*b*. This difference in edge height eases deployment of the hose out of the groove.

In use, the grooves 302, 304, 306, 308, 310, 312 function as separate placement platforms for each loop of the hose as it is placed on the device. Most devices have one wide platform for all loops, which often leads to a tangled hose and inefficient storage. In contrast, the exemplary hose holder 300 establishes an organizational system that helps the user prepare the hose for its next use, and removes the confusion and indecision as to how to store the hose when finished. The grooves 302, 304, 306, 308, 310, 312 may also serve a stiffening ribs to mechanically stabilize the holder 300 when in use.

The holder 300 may include a variety of holes 320, 322, 324, 326, 328, 330, 332, 334 suitable for the numerous attachment options for the holder 300. There are holes 320, 322 near the top of the arch of the holder 300 that are suitable for attaching the holder 300 to a post or pole or the like. There are holes 324, 326 located about midway along the arch of the holder 300 that are suitable for attaching the holder 300 to a chain link or cyclone fence or the like using zip ties or cable ties or string or wire or the like. There are holes 328, 330, 332, 334 located near the ends of the arch of the holder 300 that are suitable for attaching the holder 300 to a wall or the like using screws or bolts or the like.

The width of the hose-holding groove is configured according to the size of hose the holder is intended to hold. (The width is defined as the horizontal distance between the groove-edge inflection points. For reference, this is shown for the outermost groove 302 in FIG. 3B as dimension 354.) For example, the width of the grooves may be roughly the same as or slightly larger than the diameter of the intended hose.

Figure 4A:
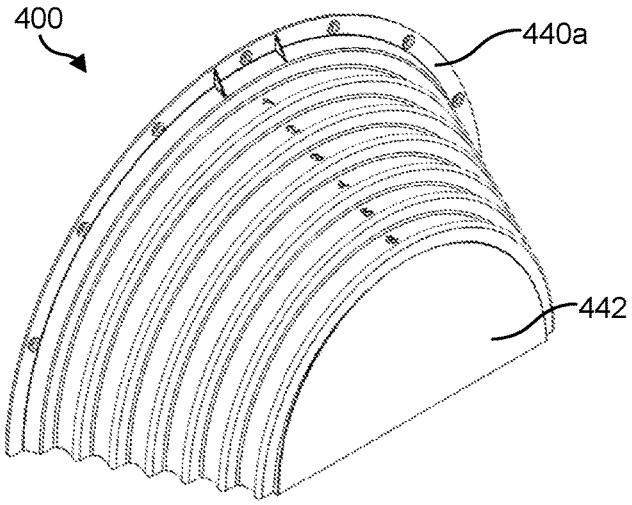
FIGS. 4A-4D depicts various views of another exemplary hose holder
Figure 4B:
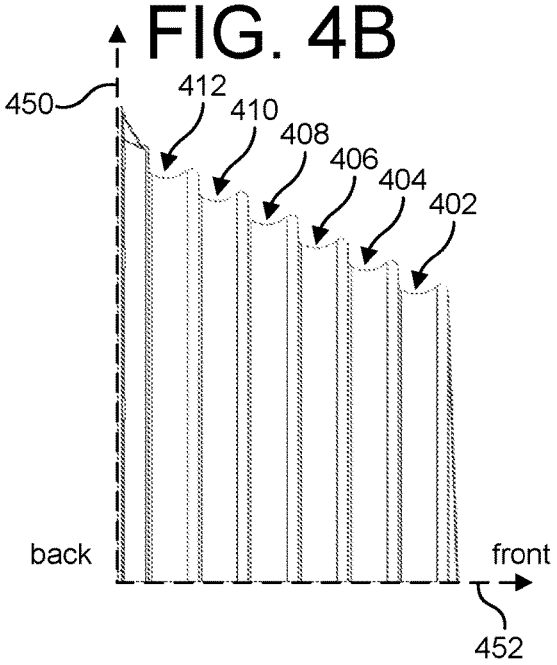
Figure 4C:
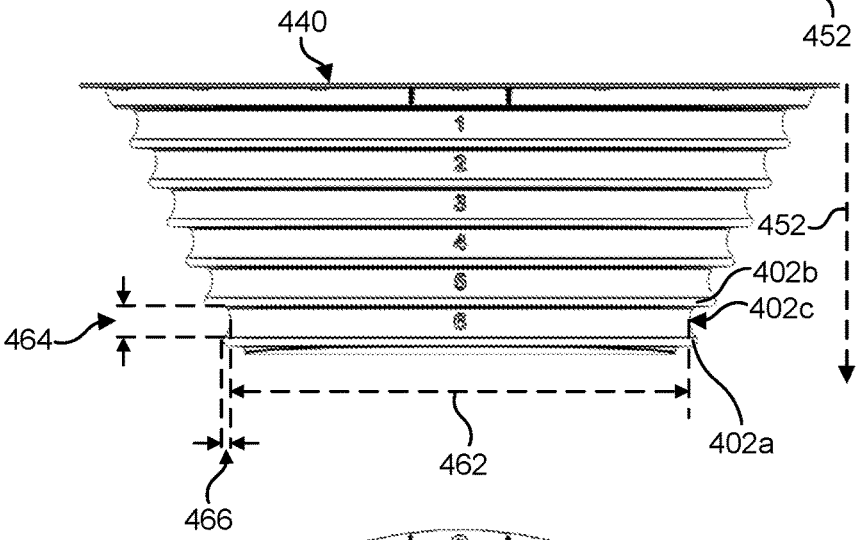
Figure 4D:
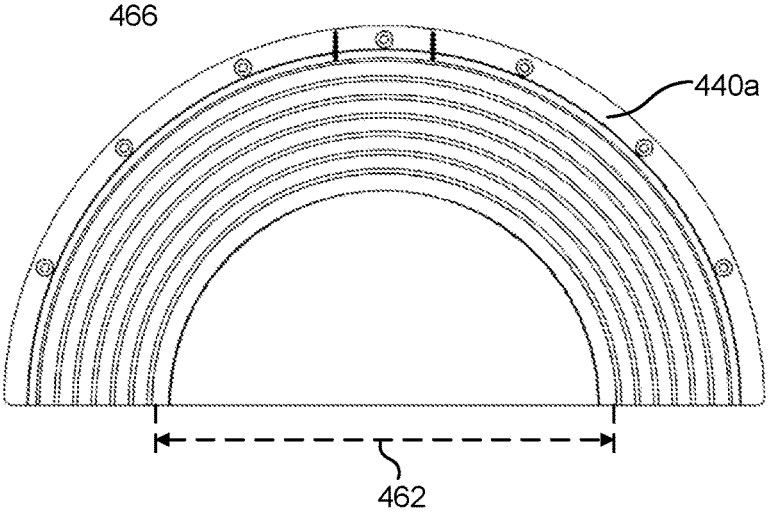

An exemplary hose holder 400 is depicted in various views in FIGS. 4A-4D. FIG. 4A is a perspective view, FIG. 4B is a side view, FIG. 4C is a top view, and FIG. 4D is a front view. The holder 400 includes a holder-mounting surface 440 and a plurality of grooves 402, 404, 406, 408, 410, 412 forming (or formed on) a hose-bearing surface sloped relative to the holder-mounting surface 440. When the holder-mounting surface 440 is oriented substantially vertically, the bottoms of the grooves 402, 404, 406, 408, 410, 412 are at different vertical positions, with the vertical position decreasing with the horizontal distance of the groove from the holder-mounting surface 440. (For reference, the holder's 400 vertical axis 450 and horizontal axis 452 are depicted in dashed lines in FIG. 4B.) This slope of the hose-holding surface (the difference in vertical positions of the grooves) provides a gravitational aid to deploying a hose, with hose loops sequentially falling off the holder when pulled.

In this embodiment, the holder's 400 grooves 402, 404, 406, 408, 410, 412 are each stamped with a number to indicate the ordering of the hose loops when storing the hose. For example, and as depicted, the grooves 402, 404, 406, 408, 410, 412 may be stamped with consecutive numbers, "6" through "1" for a 6-groove holder. This indicates to the user that the hose should be looped onto the holder 400 starting with groove "1" and proceeding consecutively through grooves "2" through "6" along the length of the hose from the second hose end (e.g., faucet end) to the first hose end (e.g., the nozzle end).

The mounting surface 440 of the holder 400 includes a lip 440*a* projecting out from the hose-holding surface. The lip 440*a* may come preconfigured with a series of mounting holes (similar to the holes described with respect to FIGS. 3A-3C). The lip 440*a* may also (or instead) accommodate customized mounting holes created by the user. For example, the lip 440*a* may extend from the hose-holding surface a sufficient extent to allow a user to drill one or more holes in the lip 440*a* as the user desires for a user-specified mounting option.

The grooves 402, 404, 406, 408, 410, 412 may be configured as a series of concentric arcs to form, for example, a truncated conical surface (e.g., a frustum) with a roughly D-shaped base. The arc of each of the grooves 402, 404, 406, 408, 410, 412 has a characteristic width defined by the distance of the bottom of the groove surface at one end of the arc from the bottom of the groove surface at the other end of the arc. This dimension is labeled as item 462 in FIGS. 4C and 4D for the groove 402 (stamped "6" in the holder 400) that is farthest from the mounting surface 440. The width of the arc of each of the grooves 402, 404, 406, 408, 410, 412 decreases as the horizontal distance of the groove from the mounting surface 440 increases. The groove arcs may be elliptical arcs (e.g., a circular arcs). The arcs may subtend roughly 180 degrees (as shown) but may subtend a greater or lesser angle and each arc may subtend a different angle than the other arcs. The area of the sector formed by the groove 402 (stamped "6" in the holder 400) that is farthest from the mounting surface 440 may be filled with a material (e.g., metal or plastic) to create a "face" 442 at the front of the holder.

Each of the grooves 402, 404, 406, 408, 410, 412 has a characteristic width and a characteristic depth. As used herein, the groove's "characteristic width" is defined as the horizontal distance between the inner groove-edge inflection points. For reference, the width 464 is shown for the frontmost groove 402 in FIG. 4C as the distance between the inner inflection points of the front edge 402*a* and the back edge 402*b*. As used herein, the groove's "characteristic depth" is defined as the vertical distance between the top of the front edge and the bottom of the groove. For reference, the depth 466 is shown for the frontmost groove 402 in FIG. 4C as the distance between the bottom 402*c* of the groove 402 and the top of the front edge 402*a*. In some embodiments, the width of the grooves may be roughly the same as or slightly larger than the diameter of the intended hose and the depth of the groove may be roughly between one-fourth and three-eighths of the width of the groove.

While the foregoing description is directed to the preferred embodiments of the invention, other and further embodiments of the invention will be apparent to those skilled in the art and may be made without departing from the basic scope of the invention. And features described with reference to one embodiment may be combined with other embodiments, even if not explicitly stated above, without departing from the scope of the invention. The scope of the invention is defined by the claims which follow.

The invention claimed is:

1. A device for holding a hose, the device comprising:

(a) a mounting surface defining a vertical axis and a horizontal axis, wherein the horizontal axis extends from the mounting surface perpendicular to the vertical axis; and (b) a hose-holding surface comprising a plurality of grooves;

(c) wherein each groove of the plurality of grooves includes a groove bottom and wherein each groove bottom of each groove of the plurality of grooves is positioned at a different vertical position relative to the vertical axis of the mounting surface and at a different horizontal position from the mounting surface relative to the horizontal axis of the mounting surface; and (d) wherein the horizontal position of each of the plurality of grooves decreases as the vertical position increases.

2. The device of claim 1 wherein each groove of the plurality of grooves is defined in part by a first groove edge extending a first height from the groove bottom and a second groove edge extending a second height from the groove bottom and wherein the first height is less than the second height.

3. The device of claim 2 wherein, for each groove of the plurality of grooves, the first height is greater than or equal to one-eighth of an inch and less than or equal to one-quarter of an inch.

4. The device of claim 2 wherein, for each groove of the plurality of grooves, the first height is greater than or equal to one-quarter of an inch and less than or equal to three-eighths of an inch.

5. The device of claim 2 wherein, for each groove of the plurality of grooves, the first height is greater than or equal to three-eighths of an inch and less than or equal to one-half of an inch.

6. The device of claim 2 wherein, for each groove of the plurality of grooves, the first height is greater than or equal to one-half of an inch and less than or equal to five-eighths of an inch.

7. The device of claim 1 further comprising an articulating joint connected to the mounting surface.

8. A device for holding a hose, the device comprising:

(a) a mounting surface defining a vertical axis and a horizontal axis, wherein the horizontal axis extends from the mounting surface perpendicular to the vertical axis; and (b) a hose-holding surface configured substantially as a surface of a truncated cone having a base coplanar with the mounting surface;

(c) wherein the hose-holding surface includes a plurality of grooves on at least a portion of the hose-holding surface; and (d) wherein the base of the truncated cone is D-shaped.

9. The device of claim 8 wherein each groove of the plurality of grooves has a characteristic width and a characteristic depth, wherein the ratio of the depth to the width is greater than or equal to one-to-eight and less than or equal to one-to-four.

10. The device of claim 8 wherein each groove of the plurality of grooves has a characteristic width and a characteristic depth, wherein the ratio of the depth to the width is greater than or equal to one-to-four and less than or equal to three-to-eight.

11. The device of claim 8 wherein each groove of the plurality of grooves has a characteristic width and a characteristic depth, wherein the ratio of the depth to the width is greater than or equal to three-to-eight and less than or equal to one-to-two.

12. The device of claim 8 wherein each groove of the plurality of grooves has a characteristic width and a characteristic depth and wherein the ratio of the depth to the width for at least one of the grooves is greater than or equal to one-to-eight and less than or equal to one-to-four.

13. A device for holding a hose, the device comprising:

(a) a mounting surface defining a vertical axis and a horizontal axis, wherein the horizontal axis extends from the mounting surface perpendicular to the vertical axis; and (b) a hose-holding surface configured substantially as a surface of a truncated cone having a base coplanar with the mounting surface;

(c) wherein the hose-holding surface includes a plurality of grooves on at least a portion of the hose-holding surface; and (d) wherein the base of the truncated cone is defined at least in part by an elliptical arc subtending a center angle less than 180°.

14. The device of claim 13 wherein each groove of the plurality of grooves has a characteristic width and a characteristic depth, wherein the ratio of the depth to the width is greater than or equal to one-to-eight and less than or equal to one-to-four.

15. The device of claim 13 wherein each groove of the plurality of grooves has a characteristic width and a characteristic depth, wherein the ratio of the depth to the width is greater than or equal to one-to-four and less than or equal to three-to-eight.

16. The device of claim 13 wherein each groove of the plurality of grooves has a characteristic width and a characteristic depth, wherein the ratio of the depth to the width is greater than or equal to three-to-eight and less than or equal to one-to-two.

17. The device of claim 13 wherein each groove of the plurality of grooves has a characteristic width and a characteristic depth and wherein the ratio of the depth to the width for at least one of the grooves is greater than or equal to one-to-eight and less than or equal to one-to-four.

* * * * *